US009558858B2

(12) United States Patent
Shortt et al.

(10) Patent No.: US 9,558,858 B2
(45) Date of Patent: Jan. 31, 2017

(54) SYSTEM AND METHOD FOR IMAGING A SAMPLE WITH A LASER SUSTAINED PLASMA ILLUMINATION OUTPUT

(71) Applicant: KLA-Tencor Corporation, Milpitas, CA (US)

(72) Inventors: David W. Shortt, Los Gatos, CA (US); Steven R. Lange, Alamo, CA (US); Matthew Derstine, Los Gatos, CA (US); Kenneth P. Gross, San Carlos, CA (US); Wei Zhao, Sunnyvale, CA (US); Ilya Bezel, Sunnyvale, CA (US); Anatoly Shchemelinin, Pleasanton, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 98 days.

(21) Appl. No.: 14/459,155

(22) Filed: Aug. 13, 2014

(65) Prior Publication Data

US 2015/0048741 A1 Feb. 19, 2015

Related U.S. Application Data

(60) Provisional application No. 61/866,020, filed on Aug. 14, 2013.

(51) Int. Cl.
*G21K 5/00* (2006.01)
*H05H 1/46* (2006.01)

(52) U.S. Cl.
CPC ..... *G21K 5/00* (2013.01)

(58) Field of Classification Search
CPC ..... H05H 1/46; G21K 5/00
USPC ..... 315/111.41, 111.21
See application file for complete search history.

(56) References Cited

U.S. PATENT DOCUMENTS

| | | | | |
|---|---|---|---|---|
| 7,705,331 | B1 * | 4/2010 | Kirk | G01N 21/956 250/306 |
| 8,896,827 | B2 * | 11/2014 | Chimmalgi | G01N 21/8806 356/237.2 |
| 2007/0272299 | A1 | 11/2007 | Schuss et al. | |
| 2008/0073598 | A1 | 3/2008 | Moriya et al. | |
| 2011/0181191 | A1 | 7/2011 | Smith et al. | |
| 2012/0205546 | A1 | 8/2012 | Solarz et al. | |
| 2013/0169140 | A1 | 7/2013 | Ko et al. | |

* cited by examiner

*Primary Examiner* — Daniel D Chang
(74) *Attorney, Agent, or Firm* — Suiter Swantz pc llo

(57) ABSTRACT

The inspection of a sample with VUV light from a laser sustained plasma includes generating pumping illumination including a first selected wavelength, or range of wavelength, containing a volume of gas suitable for plasma generation, generating broadband radiation including a second selected wavelength, or range of wavelengths, by forming a plasma within the volume of gas by focusing the pumping illumination into the volume of gas, illuminating a surface of a sample with the broadband radiation emitted from the plasma via an illumination pathway, collecting illumination from a surface of the sample, focusing the collected illumination onto a detector via a collection pathway to form an image of at least a portion of the surface of the sample and purging the illumination pathway and/or the collection pathway with a selected purge gas.

31 Claims, 10 Drawing Sheets

SYSTEM AND METHOD FOR IMAGING A SAMPLE WITH A LASER SUSTAINED PLASMA ILLUMINATION OUTPUT

PRIORITY

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of U.S. Provisional patent application entitled OPTICAL IMAGING SYSTEM WITH LASER PLASMA ILLUMINATOR, naming David Shortt, Steve Lange, Matthew Derstine, Ken Gross, Wei Zhao, Ilya Bezel, and Anatoly Schemelinin as inventors, filed Aug. 14, 2013, Application Ser. No. 61/866,020.

TECHNICAL FIELD

The present invention generally relates to plasma based light sources, and, more particularly, to a plasma light source capable of delivering vacuum ultraviolet light to an optical inspection system.

BACKGROUND

As the demand for integrated circuits having ever-small device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. Deep ultraviolet (DUV) inspectors currently utilize continuous wave (CW) plasma sources, while vacuum ultra-violet (VUV) inspectors currently utilize pulsed plasma sources. The utilization of CW and pulsed plasmas create limitations at longer wavelengths due to the utilization fused silica bulbs. Fused silica glass absorbs light have wavelengths shorter than approximately 185-190 nm. This absorption of short-wavelength light causes rapid degradation of the optical transmission capabilities of the fused silica glass bulb in spectral ranges including 190-260 nm and leads to overheating and even explosion of the bulb, thereby limiting the usefulness of powerful laser sustained plasma sources in the range of 190-260 nm. Complications currently also arise with pulsed plasma systems, including difficulties with registration, alignment, and data combination. As such, pulsed plasma systems require careful time synchronization of laser pulses, detector capture, and stage motion. Analog integration of light is also difficult because of the long path lengths required to move the analog signal. Thus, it is desirable to provide a system and method which cures the deficiencies described above in the prior art.

SUMMARY

A system for imaging a sample with a laser sustained plasma illumination output, in accordance with an illustrative embodiment of the present invention. In one illustrative embodiment, the system may include a laser sustained plasma (LSP) illumination sub-system. In another illustrative embodiment, the LSP illumination sub-system includes a pump source configured to generate pumping illumination including one or more first selected wavelengths. In another illustrative embodiment, the LSP illumination sub-system includes a gas containment element configured to contain a volume of gas. In another illustrative embodiment, the LSP illumination sub-system includes a collector configured to focus the pumping illumination from the pumping source into the volume of gas contained within the gas containment element in order to generate a plasma within the volume of gas, wherein the plasma emits broadband radiation including one or more second selected wavelengths. In another illustrative embodiment, the system includes a sample stage for securing one or more samples. In another illustrative embodiment, the system includes an imaging sub-system. In another illustrative embodiment, the imaging sub-system includes an illumination sub-system configured to illuminate a surface of the one or more samples with at least a portion of the broadband emitted from the plasma of the laser sustained plasma illumination sub-system via an illumination pathway. In another illustrative embodiment, the imaging sub-system includes a detector. In another illustrative embodiment, the imaging sub-system includes an objective configured to collect illumination from a surface of the one or more samples and focus the collected illumination via a collection pathway to a detector to form an image of at least a portion of the surface of the sample. In another illustrative embodiment, the system includes a purged chamber containing a selected purge gas and configured to purge at least a portion of the illumination pathway and the collection pathway.

A method for laser sustained plasma imaging of a sample is disclosed, in accordance with an illustrative embodiment of the present invention. In one illustrative embodiment, the method includes generating pumping illumination including one or more first selected wavelengths. In one illustrative embodiment, the method includes containing a volume of gas suitable for plasma generation. In one illustrative embodiment, the method includes generating broadband radiation including one or more second selected wavelengths by forming a plasma within the volume of gas by focusing the pumping illumination into the volume of gas. In one illustrative embodiment, the method includes illuminating a surface of one or more samples with at least a portion of the broadband radiation emitted from the plasma via an illumination pathway. In one illustrative embodiment, the method includes collecting illumination from a surface of the sample. In one illustrative embodiment, the method includes focusing the collected illumination onto a detector via a collection pathway to form an image of at least a portion of the surface of the sample. In one illustrative embodiment, the method includes purging at least a portion of the illumination pathway and the collection pathway with a selected purge gas It is to be understood that both the foregoing general description and the following detailed description are exemplary and explanatory only and are not necessarily restrictive of the present disclosure. The accompanying drawings, which are incorporated in and constitute a part of the characteristic, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A through 8, a system and method for imaging a sample with laser sustained plasma illumination are described in accordance with the present disclosure. Embodiments of the present disclosure are directed to the optical inspection of samples using short wavelength illumination, such as VUV radiation, generated with a laser sustained plasma light source. Embodiments of the present disclosure are directed to the coupling of the short wavelength optical output of a laser sustained plasma light source with illumination optics of a corresponding imaging sub-system (e.g., inspection sub-system, metrology sub-system and the like). Additional embodiments of the present disclosure are directed to the separation of plasma pumping illumination (e.g., IR light) from the short wavelength broadband output (e.g., VUV light) within the laser sustained plasma source.

Figure 1A:
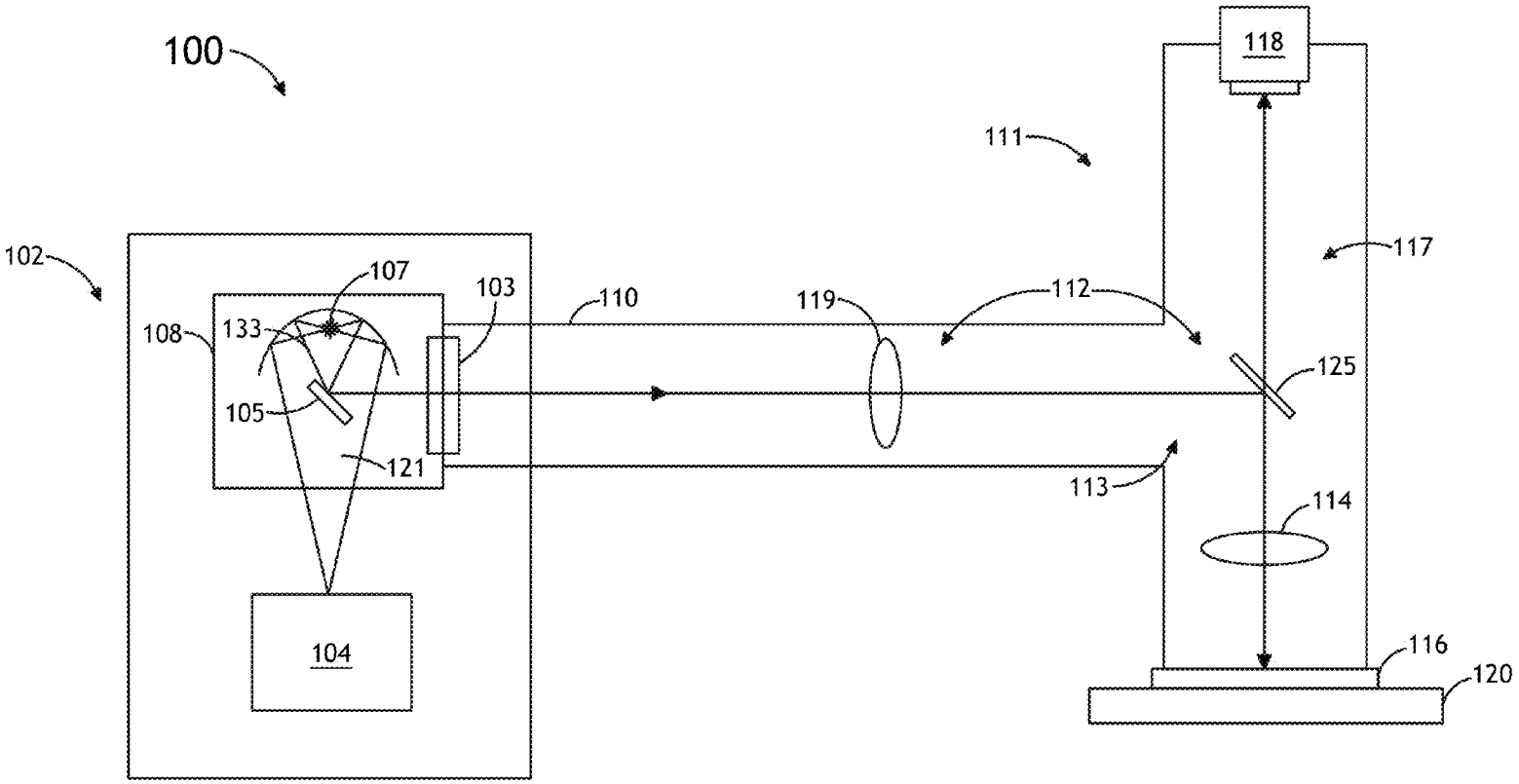
FIG. 1A is a conceptual view of a system for imaging a sample with a laser sustained plasma illumination output, in accordance with one embodiment of the present invention.

FIG. 1A illustrates a system 100 for imaging a sample with a laser sustained plasma illumination output, in accordance with an embodiment of the present disclosure. The generation of plasma within inert gas species is generally described in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are incorporated herein in their entirety. The generation of plasma is also generally described in U.S. patent application Ser. No. 14/224,945, filed on Mar. 25, 2014, which is incorporated by reference herein in the entirety. Further, the use of a plasma cell is described in U.S. patent application Ser. No. 14/231,196, filed on Mar. 31, 2014; and U.S. patent application Ser. No. 14/288,092, filed on May 27, 2014, which are each incorporated herein by reference in the entirety. In a general sense, the system 100 should be interpreted to extend to any plasma based light source known in the art.

In one embodiment, the system 100 includes a laser sustained plasma (LSP) illumination sub-system 102. It is noted herein that the term 'LSP illumination sub-system 102' is used interchangeably with 'LSP illuminator' throughout the present disclosure. In one embodiment, the LSP illumination sub-system 102 includes a pump source 104 configured to generate pumping illumination 121 including of one or more first selected wavelengths, such as, but not limited to infrared (IR) radiation, visible light and ultraviolet light. For example, the pump source 104 may include any source capable of emitting illumination in the range of approximately 200 nm to 1.5 μm. In another embodiment, the LSP illumination sub-system 102 includes a gas containment element 108, such as, but not limited to, a chamber, a plasma cell or a plasma bulb. In one embodiment, the gas containment element 108 contains a volume of gas used to establish and maintain a plasma 107. In another embodiment, the LSP illumination sub-system 102 includes a collector 106, or reflector, configured to focus (e.g., via a reflective internal surface) the pumping illumination 121 from the pumping source 104 into the volume of gas contained within the gas containment element 108. In this regard, the collector 106 may generate a plasma 107 within the volume of gas. Further, the plasma 107 may emit broadband radiation 133 including one or more second selected wavelengths, such as, but not limited to, VUV radiation, DUV radiation, UV radiation and visible light. For example, the LSP illumination sub-system 102 may include, but is not limited to, any LSP configuration capable of emitting light having a wavelength in the range of 100 to 200 nm. By way of another example, the LSP illumination sub-system 102 may include, but is not limited to, any LSP configuration capable of emitting light having a wavelength below 100 nm. In another embodiment, the collector 106 is arranged to collect the broadband illumination 133 (e.g., VUV radiation, DUV radiation, UV radiation and/or visible light) emitted by plasma 107 and direct the broadband illumination 133 to one or more additional optical elements (e.g., steering optics, beam splitter, collecting aperture, filter, homogenizer and the like). For example, the collector 106 may collect at least one of VUV broadband radiation, DUV broadband radiation, UV broadband radiation or visible light emitted by plasma 107 and direct the broadband illumination 133 to a mirror 105 (e.g., mirror 105 serving to optically couple LSP illumination sub-system 102 to an optical input of the illumination sub-system 112 of the imaging sub-system 111). In this regard, the LSP illumination sub-system 102 may deliver VUV radiation, DUV radiation, UV radiation and/or visible radiation to downstream optical elements of any optical characterization system known in the art, such as, but not limited to, an inspection tool or a metrology tool.

In another embodiment, the system 100 includes a stage assembly 120 suitable for securing a sample 116. The stage assembly 120 may include any sample stage architecture known in the art. For example, the stage assembly 120 may include, but is not limited to, a linear stage. By way of another, the stage assembly 120 may include, but is not limited to, a rotational stage. Further, the sample 120 may include a wafer, such as, but not limited to, a semiconductor wafer.

In another embodiment, the system 100 includes an imaging sub-system 111. It is noted herein that the imaging sub-system 111 may be coupled to the illumination output of the LSP illumination sub-system 102. In this regard, the imaging sub-system 111 may inspect, or otherwise analyze, one or more samples 116 utilizing the illumination output (e.g., VUV light) from the LSP illumination sub-system 102. It is noted herein that throughout the present disclosure the term 'imaging sub-system' is used interchangeably with the term 'inspector.'

In another embodiment, the imaging sub-system 111 includes an illumination sub-system 112, or an 'illuminator.' In one embodiment, the illumination sub-system 112 illuminates a surface of the one or more samples 116 with at least a portion of the broadband radiation emitted from the plasma 107 generated by the laser sustained plasma illumination sub-system 102. In on embodiment, the illumination sub-system 112 delivers the broadband radiation 133 to the surface of the sample 116 via an illumination pathway 113. The illumination sub-system 112 may include any number and type of optical elements suitable for delivering broadband radiation 133 from an output of the LPS sub-system 102 to the surface of the sample 116. For example, the illumination sub-system 112 may include one or more lenses 119, one or more filters 130 (e.g., sub-band filter), one or more collimating elements (not shown), one or more polarizing elements (not shown), one or more beam splitters 125 for directing, focusing and otherwise processing broadband radiation 133 emitted by the LSP illumination sub-system 102.

In another embodiment, the imaging sub-system 111 includes an objective 114 and a detector 118. In one embodiment, the objective 114 may collect illumination after it is scattered or reflected from one or more portions of the sample 116 (or particles disposed on the sample 116). Then, the objective may focus the collected illumination via a collection pathway 117 to a detector 118 to form an image of one or more portions of the surface of the sample 116. It is noted herein that the objective 114 may include any objective known in the art suitable for performing inspection (e.g., darkfield inspection or brightfield inspection) or optical metrology. Further, it is noted herein that the detector 118 may include any optical detector known in the art suitable for measuring illumination received from the sample 116. For example, the detector 118 may include, but is not limited to, a CCD detector, a TDI detector or the like.

In another embodiment, the system 100 includes a purged chamber 110. In one embodiment, the purged chamber 110 contains, or is suitable for containing, a selected purge gas. In one embodiment, the purged chamber 110 contains the illumination sub-system 113, the objective 114 and/or the detector 118. In another embodiment, the purged chamber 110 purges the illumination pathway 113 and/or the collection pathway 117 with a selected purge gas. It is noted herein that the use of a purged chamber 110 allows the collected plasma-generated broadband light 133, such as VUV light, to be transmitted through the illumination optics of the illumination sub-system 112 with minimal signal degradation, or at least reduced degradation. The use of a purging gas in the purged chamber 110 allows for the utilization of shorter wavelength light, such as VUV light, during inspection and avoids the need for performing pulsed plasma inspection for short wavelength regimes, such as, but not limited to, VUV light (100-200 nm). It is further recognized that such a configuration enables the utilization of a TDI-based sensor in detector 118. The purge gas used in purged chamber 110 may include any purge gas known in the art. For example, the selected purge gas may include, but is not limited to, a noble gas, an inert gas, a non-inert gas or a mixture two or more gases. For instance, the selected purge gas may include, but is not limited to, argon, Xe, Ar, Ne, Kr, He, $N_2$ and the like. By way of another example, the selected purge gas may include a mixture of argon with an additional gas.

In another embodiment, the system 100 includes a window 103 transparent to at least a portion of the broadband radiation 133. The window 103 serves to optically couple the illumination sub-system 112 with the output of the LSP illumination sub-system 102, while maintaining a separation between the atmosphere of the purge chamber 110 and the atmosphere of the LSP illumination sub-system 102 (and component systems). For example, in the case of VUV broadband radiation emitted from the plasma 107, the window 103 may include a material transparent to VUV radiation. For instance, a VUV-suitable window may include, but is not limited to, $CaF_2$ or $MgF_2$.

Figure 1B:
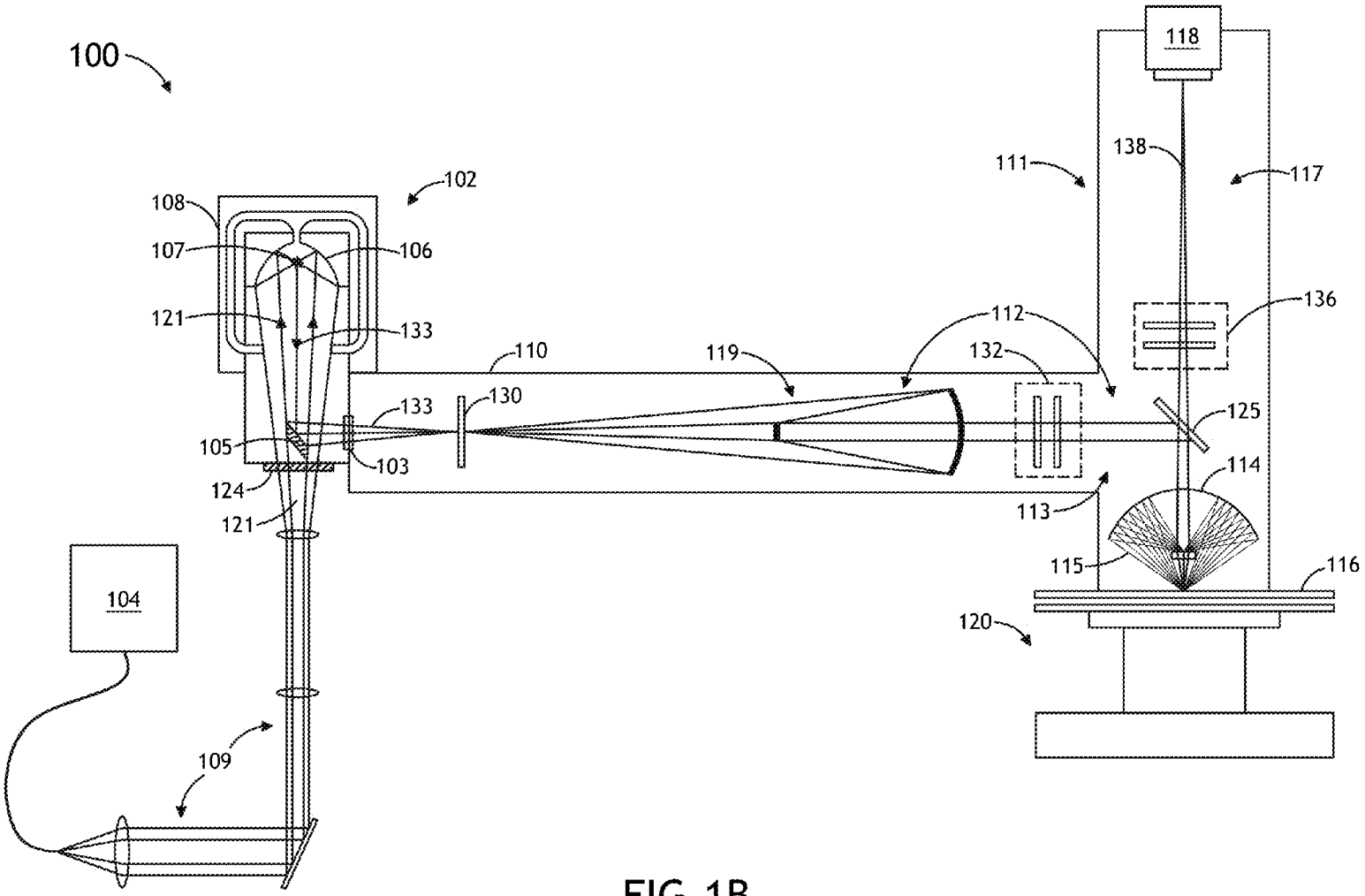
FIG. 1B is a conceptual view of a system for imaging a sample with a laser sustained plasma illumination output, in accordance with one embodiment of the present invention.
Figure 2:
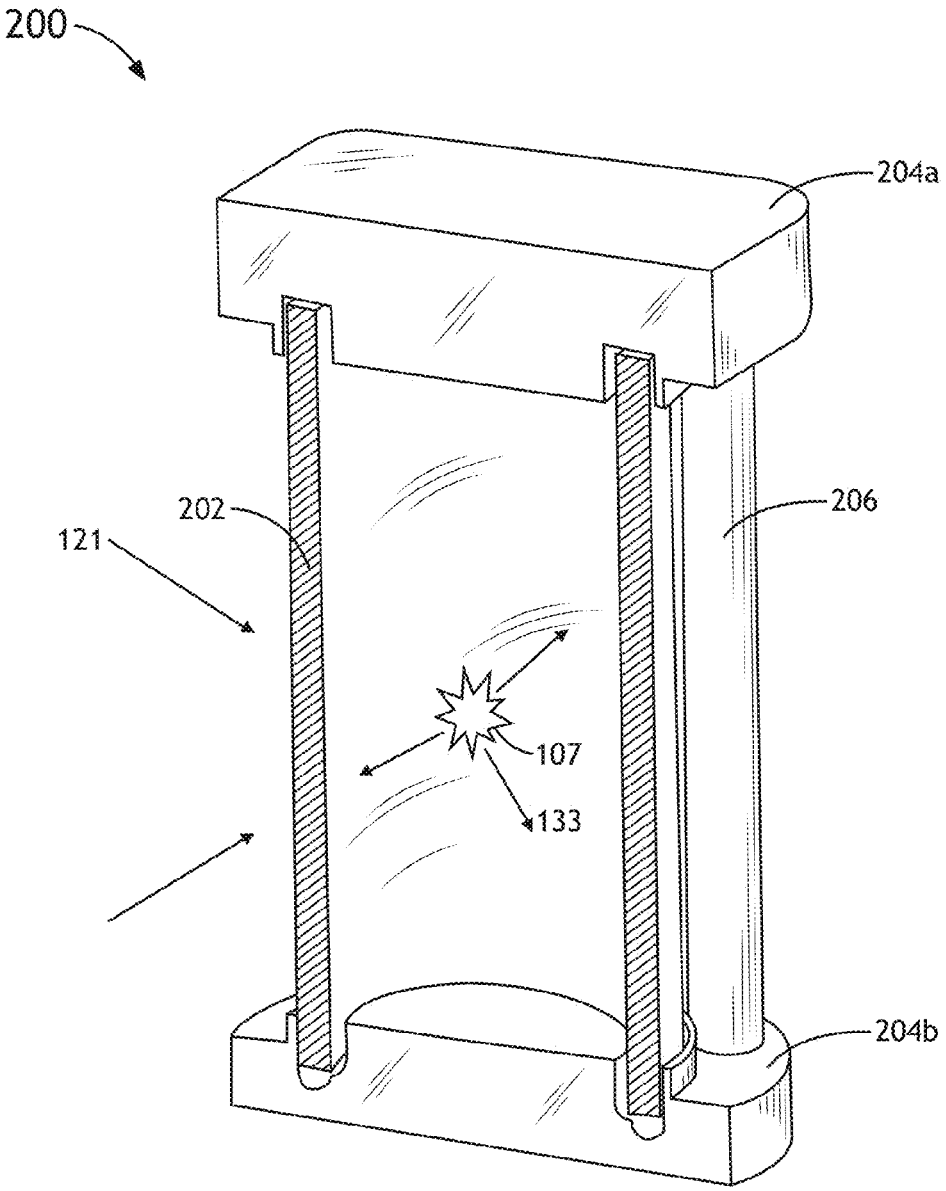
FIG. 2 is a schematic view of a plasma cell, in accordance with one embodiment of the present invention.

It is recognized herein that the gas containment element 108 may include a number of gas-containing structures suitable for initiating and/or maintaining a plasma 107. In one embodiment, the gas containment element 108 may include, but is not limited to, a chamber (as shown in FIG. 1B), a plasma cell (as shown in FIG. 2) or a plasma bulb.

In some embodiments, the transmitting portion of the gas containment element 108 (e.g., chamber, cell or bulb) may be formed from any material known in the art that is at least partially transparent to radiation 133 generated by plasma 107 and/or the pump illumination 121. In one embodiment, the transmitting portion of the gas containment element 108 may be formed from any material known in the art that is at least partially transparent to VUV radiation, DUV radiation, UV radiation and/or visible light generated by plasma 107. In another embodiment, the transmitting portion of the gas containment element 108 may be formed from any material known in the art that is at least partially transparent to IR radiation, visible light and/or UV light from the pump source 104.

In some embodiments, the transmitting portion of the gas containment structure may be formed from a low-OH content fused silica glass material. In other embodiments, the transmitting portion of the plasma cell 101 may be formed from high-OH content fused silica glass material. For example, the transmission element or bulb of the plasma cell 101 may include, but is not limited to, SUPRASIL 1, SUPRASIL 2, SUPRASIL 300, SUPRASIL 310, HERALUX PLUS, HERALUX-VUV, and the like. In other embodiments, the transmission element or bulb of the plasma cell 101 may include, but is not limited to, $CaF_2$, $MgF_2$, crystalline quartz and sapphire. It is again noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the gas containment element 108 (e.g., chamber window, glass bulb or transmission element/window of plasma cell) of the present disclosure are discussed in detail in A. Schreiber et al., *Radiation*

*Resistance of Quartz Glass for VUV Discharge Lamps*, J. Phys. D: Appl. Phys. 38 (2005), 3242-3250, which is incorporated herein by reference in the entirety.

In one embodiment, the gas containment element 108 may contain any selected gas (e.g., argon, xenon, mercury or the like) known in the art suitable for generating a plasma upon absorption of pump illumination 104. In one embodiment, focusing illumination 121 from the pump source 104 into the volume of gas causes energy to be absorbed by the gas or plasma (e.g., through one or more selected absorption lines) within the plasma cell 107, thereby "pumping" the gas species in order to generate and/or sustain a plasma. In another embodiment, although not shown, the gas containment structure 108 may include a set of electrodes for initiating the plasma 107 within the internal volume of the gas containment structure 108, whereby the illumination from the pump source 104 maintains the plasma 107 after ignition by the electrodes.

It is contemplated herein that the system 100 may be utilized to initiate and/or sustain a plasma 107 in a variety of gas environments. In one embodiment, the gas used to initiate and/or maintain plasma 107 may include a noble gas, an inert gas (e.g., noble gas or non-noble gas) or a non-inert gas (e.g., mercury). In another embodiment, the gas used to initiate and/or maintain a plasma 107 may include a mixture of two or more gases (e.g., mixture of inert gases, mixture of inert gas with non-inert gas or a mixture of non-inert gases). In another embodiment, the gas may include a mixture of a noble gas and one or more trace materials (e.g., metal halides, transition metals and the like).

By way of example, the volume of gas used to generate a plasma 107 may include argon. For instance, the gas may include a substantially pure argon gas held at pressure in excess of 5 atm (e.g., 20-50 atm). In another instance, the gas may include a substantially pure krypton gas held at pressure in excess of 5 atm (e.g., 20-50 atm). In another instance, the gas may include a mixture of argon gas with an additional gas.

It is further noted that the present invention may be extended to a number of gases. For example, gases suitable for implementation in the present invention may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the present invention should be interpreted to extend to any light pumped plasma generating system and should further be interpreted to extend to any type of gas suitable for sustaining a plasma within a gas containment structure, such as a gas chamber, a plasma cell or a plasma bulb.

The collector 106 may take on any physical configuration known in the art suitable for focusing illumination emanating from the pump source 104 into the volume of gas contained within the gas containment element 108. In one embodiment, the collector 106 may include a concave region with a reflective internal surface suitable for receiving illumination 121 from the pump source 104 and focusing the illumination into the volume of gas contained within the gas containment element 108. For example, the collector 106 may include an ellipsoid-shaped collector 106 having a reflective internal surface.

It is noted herein that LSP illumination sub-system 102 may include any number and type of additional optical elements. In one embodiment, the set of additional optics may include collection optics configured to collect broadband light emanating from the plasma 107. For instance, the LSP illumination sub-system 102 may include one or more additional optical elements arranged to direct illumination from the collector 106 to downstream optics. In another embodiment, the set of optics may include one or more lenses placed along either the illumination pathway or the collection pathway of the LSP illumination sub-system 102. The one or more lenses may be utilized to focus illumination from the pump source 104 into the volume of gas within the gas containment element 108. Alternatively, the one or more additional lenses may be utilized to focus broadband light emanating from the plasma 107 to a selected target or a focal point (e.g., focal point within illumination sub-system 112).

In another embodiment, the set of optics may include one or more filters placed along either the illumination pathway or the collection pathway of the LSP illumination sub-system 102 in order to filter illumination prior to light entering the gas containment element 108 or to filter illumination following emission of the light from the plasma 107. It is noted herein that the set of optics of the LSP illumination sub-system 102 as described herein are provided merely for illustration and should not be interpreted as limiting. It is anticipated that a number of equivalent or additional optical configurations may be utilized within the scope of the present invention.

In another embodiment, the pump source 104 of system 100 may include one or more lasers. In a general sense, pump source 104 may include any laser system known in the art. For instance, the pump source 104 may include any laser system known in the art capable of emitting radiation in the infrared, visible or ultraviolet portions of the electromagnetic spectrum. In one embodiment, the pump source 104 may include a laser system configured to emit continuous wave (CW) laser radiation. For example, the pump source 104 may include one or more CW infrared laser sources. For example, in settings where the gas within the gas containment element 108 is or includes argon, the pump source 104 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present invention.

In another embodiment, the pump source 104 may include one or more diode lasers. For example, the pump source 104 may include one or more diode lasers emitting radiation at a wavelength corresponding with any one or more absorption lines of the species of the gas contained within the gas containment element 108. In a general sense, a diode laser of pump source 104 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the gas containment element 108 of system 100.

In another embodiment, the pump source 104 may include an ion laser. For example, the pump source 104 may include any noble gas ion laser known in the art. For instance, in the case of an argon-based plasma, the pump source 104 used to pump argon ions may include an Ar+ laser.

In another embodiment, the pump source 104 may include one or more frequency converted laser systems. For example, the pump source 104 may include a Nd:YAG or Nd:YLF laser having a power level exceeding 100 watts. In another embodiment, the pump source 104 may include a broadband laser. In another embodiment, the pump source 104 may include a laser system configured to emit modulated laser radiation or pulsed laser radiation.

In another embodiment, the pump source 104 may include one or more lasers configured to provide laser light at substantially a constant power to the plasma 107. In another embodiment, the pump source 104 may include one or more modulated lasers configured to provide modulated laser light to the plasma 107. In another embodiment, the pump source 104 may include one or more pulsed lasers configured to provide pulsed laser light to the plasma 107.

In another embodiment, the pump source 104 may include one or more non-laser sources. In a general sense, the pump source 104 may include any non-laser light source known in the art. For instance, the pump source 104 may include any non-laser system known in the art capable of emitting radiation discretely or continuously in the infrared, visible or ultraviolet portions of the electromagnetic spectrum.

In another embodiment, the pump source 104 may include two or more light sources. In one embodiment, the pump source 104 may include two or more lasers. For example, the pump source 104 (or "sources") may include multiple diode lasers. By way of another example, the pump source 104 may include multiple CW lasers. In another embodiment, each of the two or more lasers may emit laser radiation tuned to a different absorption line of the gas or plasma within the gas containment element 108 of system 100. In this regard, the multiple pulse sources may provide illumination of different wavelengths to the gas within the gas containment element 108.

FIG. 1B illustrates the system 100, in accordance with an additional embodiment of the present disclosure. It is noted herein that the various embodiments and components described previously herein with respect to FIG. 1A should be interpreted to extend to FIG. 1B and are not repeated for purposes of clarity. In one embodiment, the LSP illumination sub-system 102 includes a set of illumination optics 109 configured to transmit illumination 121 from the pump source 104 to an entrance window 124 of the gas containment element 108. In another embodiment, the collector 106 may then collect the pumping illumination 121 and focus it into the gas in order generate a plasma 107. The plasma 107, in turn, emits broadband radiation 107 (e.g., VUV, DUV or UV light), which is collected by the collector 106 and directed to optical element 105. In one embodiment, the optical element 105 includes any optical element suitable for separating the pump illumination 121 and the collected broadband radiation 133. Various types of optical configurations suitable for separating pump illumination 121 and the collected broadband radiation 133 are described in detail further herein. It is contemplated that each of the approaches for pump/broadband light separation described in the present disclosure is extendable to system 100. In another embodiment, optical element 105 may direct the broadband output 133 to one or more downstream optical elements 119 of the illumination sub-system 112 of the imaging sub-system 111 (i.e., inspection sub-system or inspector). It is noted herein that the illumination sub-system 112 may include a reflective based optical system, a refractive based optical system or a catadioptric optical system. In another embodiment, the illumination sub-system 112 may include a pupil assembly 132 located within the illumination pathway 113. In another embodiment, after the illumination 133 is transmitted through the illumination pupil assembly 132, the beam splitter 125 directs the illumination 133 onto the surface of the sample (e.g., wafer) disposed on the stage assembly 120. Further, the objective 114 may collect illumination 115 that is scattered, reflected or otherwise directed from the surface of the sample 116. Then, the objective 114 may focus the collected illumination 138 and direct the focused illumination to the detector 118 for imaging. In another embodiment, the focused illumination 138 is transmitted through collection pupil assembly 136 positioned along the collection pathway 117.

FIG. 2 illustrates a plasma cell 200 suitable for use as the gas containment element 108 in the LSP illumination sub-system 102. In one embodiment, the plasma cell 200 may include, but is not limited to, a transmission element 202 in combination with one or more flanges 204*a*, 204*b* for containing a gas suitable for initiating and/or maintaining a plasma 107. In another embodiment, the flanges 204*a*, 204*b* may be secured to the transmission element 202 (e.g., hollow cylinder) using connection rods 206. The use of a flanged plasma cell is described in at least U.S. patent application Ser. No. 14/231,196, filed on Mar. 31, 2014; and U.S. patent application Ser. No. 14/288,092, filed on May 27, 2014, which are each incorporated previously herein by reference in the entirety. In another embodiment, a plasma bulb may be used as the gas containment element 108. The use of a plasma bulb is described in at least in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are each incorporated previously herein by reference in the entirety. The use of a self-contained gas chamber is described in U.S. patent application Ser. No. 12/787,827, filed on May 26, 2010, which is incorporated herein by reference in the entirety.

Figure 3:
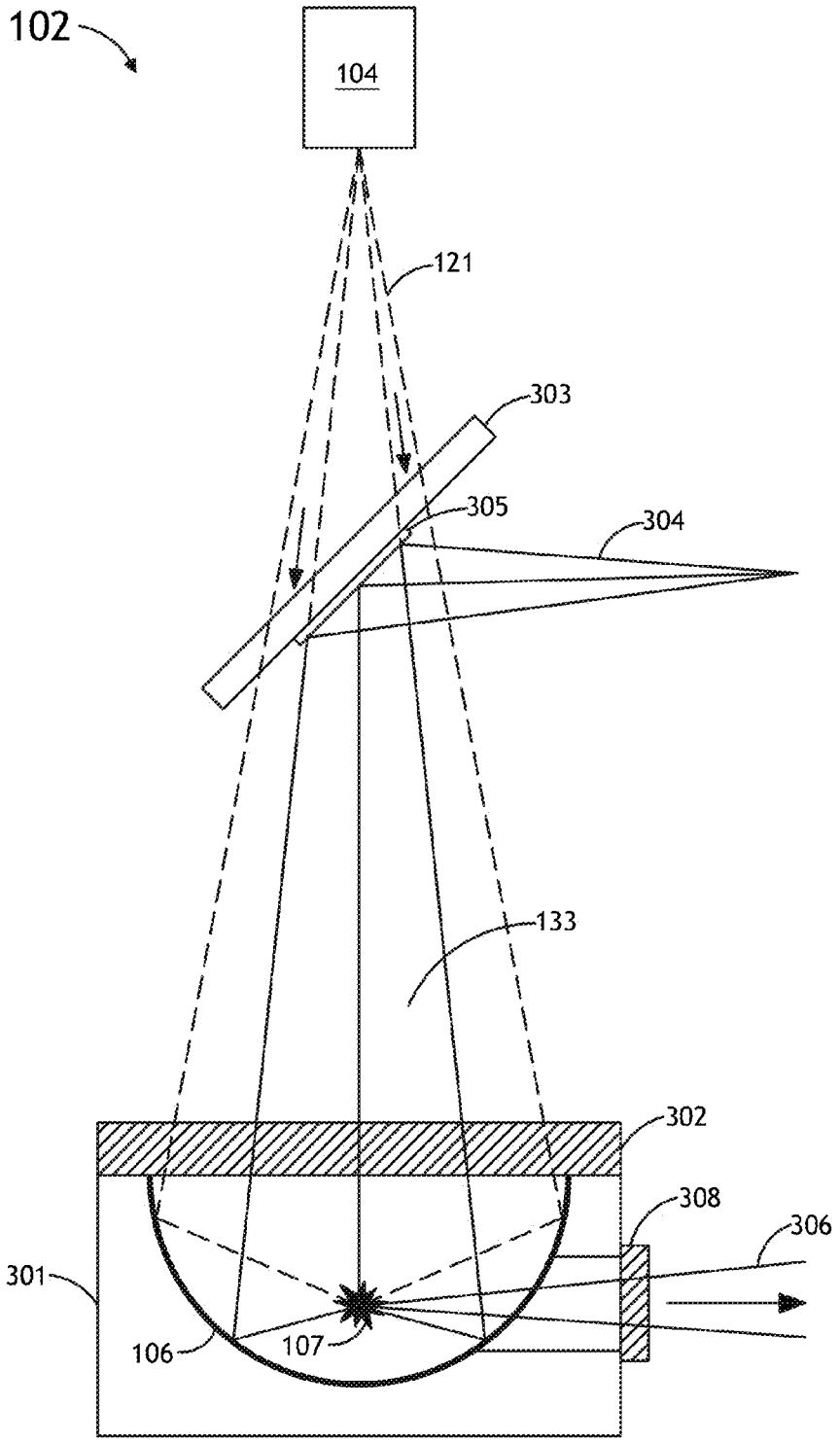
FIG. 3 is a schematic view of a laser sustained plasma sub-system, in accordance with one embodiment of the present invention.

FIG. 3 illustrates a LSP sub-system 102, in accordance with one embodiment of the present invention. In one embodiment, the LSP illumination sub-system 102 includes a chamber 301 for containing a gas suitable for maintaining the plasma 107, as described previously herein. In another embodiment, the gas contained within chamber 301 is pressurized. In another embodiment, the LSP illumination sub-system 102 includes a window 302 transparent to both the incident pump illumination 121 (e.g., IR light) and the generated broadband radiation 133 (e.g., VUV light). For example, in the case of IR pump illumination and VUV broadband plasma-generated radiation, the window 302 may be formed from $CaF_2$, $MgF_2$ or the like. In one embodiment, the generated broadband radiation 133 and the pump illumination 121 occupy different portions of numerical aperture space.

In one embodiment, the LSP illumination sub-system 102 includes a cold mirror 303 having a reflective coating 305 that is reflective to the generated broadband radiation 133 (or a portion of the generated broadband radiation 133). Further, the cold mirror 303 is transparent to the pumping illumination 121. For example, the reflective coating 305 may be disposed on the central portion of the cold mirror 303, as shown in FIG. 3. In one embodiment, the cold mirror 303 is positioned between a reflective surface of the collector 106 and the pump source 104. In another embodiment, the broadband radiation 133 and the pump illumination 121 are separated via the cold mirror 303. In this regard, the reflective coating of the cold mirror 303 may direct the reflected broadband radiation 304 (e.g., VUV light to downstream optical elements (e.g., illumination sub-system 112 and components thereof). In another embodiment, the LPS illumination sub-system 102 includes an additional window 308. The additional window 308 may be constructed of any material transparent to emitted broadband radiation 133. In this regard, a second beam 306 of broadband radiation (e.g., having an NA below a selected value) may be transmitted through window 308 and used for a purpose other than the reflected beam 304.

Figure 4:
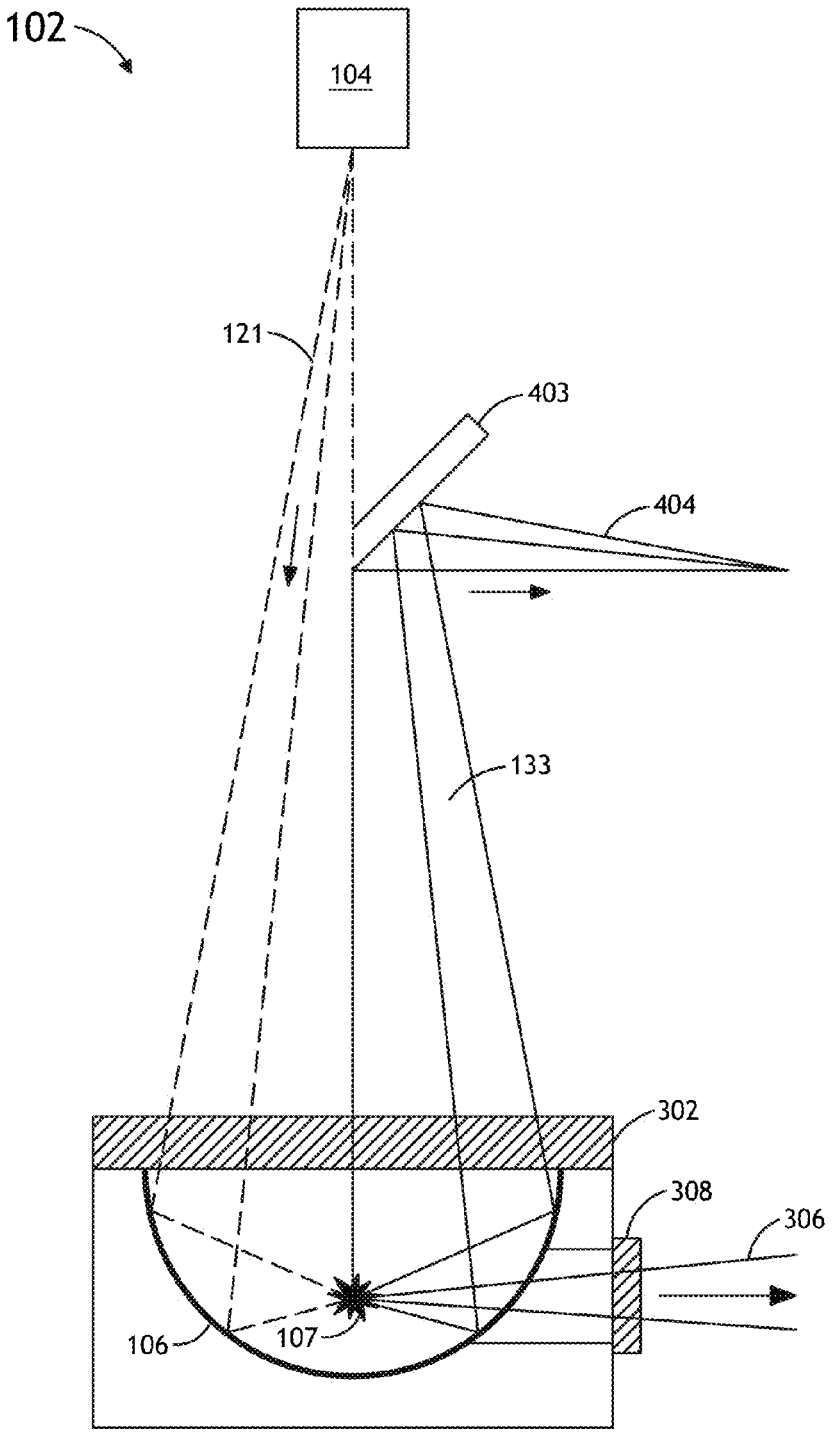
FIG. 4 is a schematic view of a laser sustained plasma sub-system, in accordance with one embodiment of the present invention.

FIG. 4 illustrates the LSP sub-system 102 in a configuration with the pumping illumination 133 and the plasma-generated broadband radiation occupying different portions of the NA space across the pupil. It is noted herein that unless otherwise noted the various components of the LSP sub-system 102 described previously herein should be interpreted to extend to FIG. 4.

In one embodiment, the LSP illumination sub-system 102 includes one or more optical elements 403 configured to divide a pupil of the laser sustained plasma sub-system 102 laterally. In this regard, one or more optical elements 403 may be positioned and oriented such that the pumping illumination 121 and the broadband radiation 133 occupy different portions of NA space, thereby splitting the pupil "side-by-side," as shown in FIG. 4. For example, the one or more optical elements 403 may include a cold mirror 403 that extends only partially across the NA space of the LSP illumination sub-system 102. For instance, as shown in FIG. 4, the cold mirror 403 may be arranged to only extend along the right portion of the LSP illumination sub-system 102, which results in no broadband radiation from the left side of the LSP illumination sub-system 102 being re-directed by the cold mirror 403. It is noted herein that the above example is illustrative only and it is contemplated that the positioning of the cold mirror 403 is not limited to that depicted in FIG. 4. In another embodiment, the cold mirror 403 may be selected such that it is reflective to the pump illumination 121 or includes a coating reflective to the pump illumination 121. In this regard, the cold mirror 403 or the coating of the cold mirror 403 may serve to reflect pump illumination 121 that strays into the right side (for illustration only) of the pupil of the LSP sub-system 102. In another embodiment, the window 302 may include a differential coating. For example, on one side (e.g., left side) of the window 302 may include a coating reflective to the broadband radiation 133 such that broadband radiation 133 is not transmitted on that half (e.g., left side) of the window. Further, on the opposite side (e.g., right side) of the window 302 may include a coating reflective to the pumping illumination 121 such that pumping illumination 121 is not transmitted on that half (e.g., right side) of the window.

Figure 5:
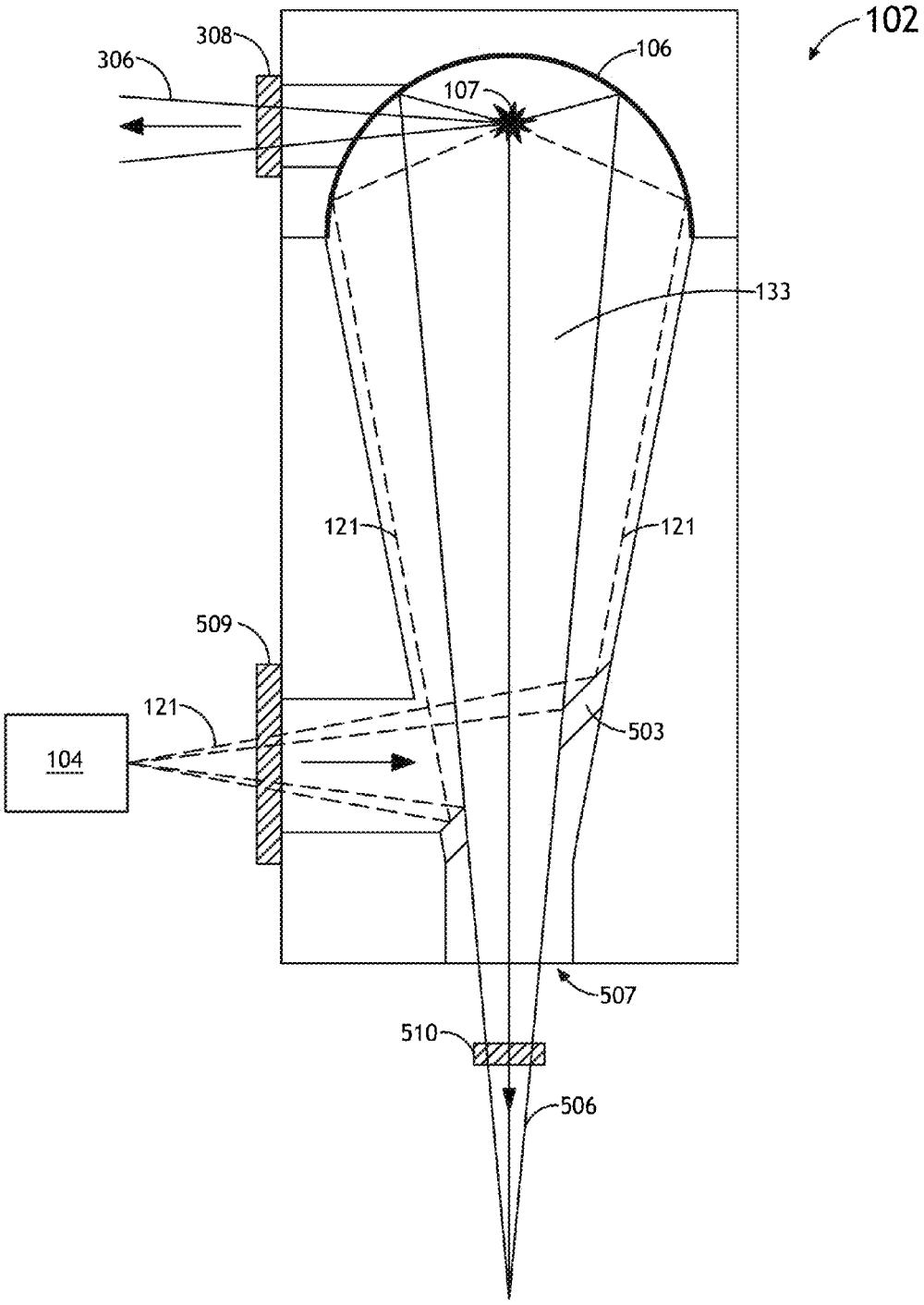
FIG. 5 is a schematic view of a laser sustained plasma sub-system, in accordance with one embodiment of the present invention.

FIG. 5 illustrates the LSP sub-system 102 in a configuration with the pumping illumination 133 and the plasma-generated broadband radiation occupying different zones of the NA space across the pupil, in accordance with another embodiment of the present disclosure.

It is noted herein that unless otherwise noted the various components of the LSP sub-system 102 described previously herein should be interpreted to extend to FIG. 5.

In one embodiment, the LSP illumination sub-system 102 includes one or more optical elements 503 configured to divide a pupil of the laser sustained plasma sub-system such that the pumping illumination 121 occupies a first portion of the pupil having a first NA range and the broadband radiation occupies a second portion of the pupil having a second NA range. For example, as shown in FIG. 5, the LSP illumination sub-system 102 includes an annular mirror 503. The mirror 503 reflects pumping illumination from an outer radial zone toward the collector 106, while generated broadband radiation 133 is allowed to pass through the central radial zone through the center portion of the annular mirror 503. In another embodiment, the LSP illumination sub-system 102 includes an opening 507 for allowing the central zone broadband radiation 133 to be directed to downstream optics, as described throughout the present invention. In another embodiment, the LSP illumination sub-system 102 includes a filter element 510. For example, filter element 510 may filter out the pumping illumination 121 (e.g., IR light), so that any pumping illumination present in the central radial zone is removed from the illumination output 506 prior to being passed on to downstream optics. It is noted herein that the configuration depicted in FIG. 5 is not limiting and is provided merely for illustrative reasons. For example, an alternative optical element 503 may allow for pumping illumination to propagate towards the collector 106 through the central radial zone of the LSP illumination sub-system 102, while generated broadband radiation 133 propagates through the outer radial zone.

It is noted herein that the optical elements of the LSP illumination sub-system 102 may divide the pupil of the laser sustained plasma sub-system 102 symmetrically or asymmetrically. In this regard, the separation of pumping illumination and plasma-generation broadband radiation may be symmetric or asymmetric.

The separation of pumping illumination and plasma-generation broadband radiation into different portions of the NA space are described in U.S. patent application Ser. No. 13/026,926, filed on Feb. 14, 2011, which is incorporated herein by reference in the entirety.

Figure 6A:
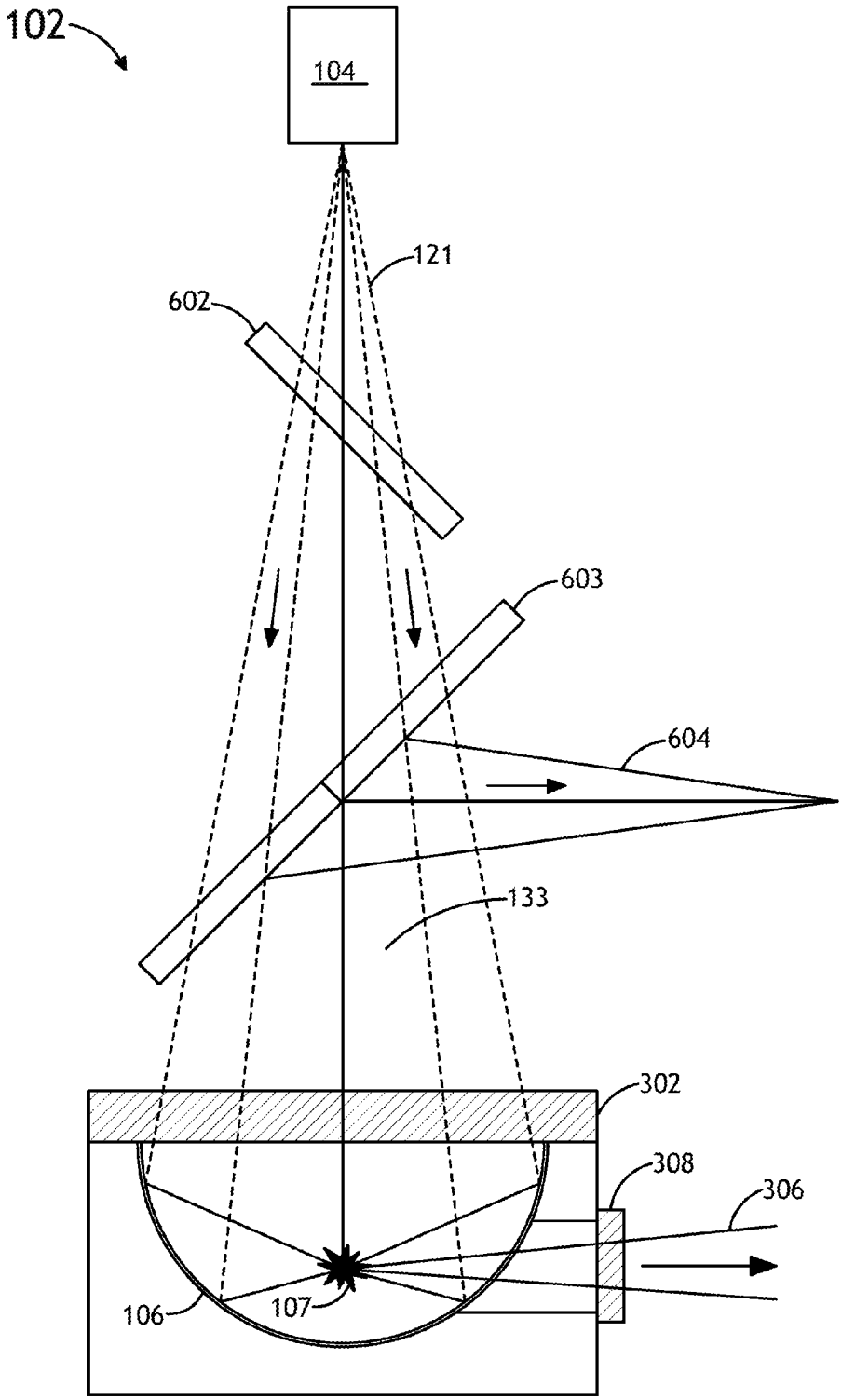
FIG. 6A is a schematic view of a laser sustained plasma sub-system, in accordance with one embodiment of the present invention.

FIG. 6A illustrates the LSP illumination sub-system 102, in accordance with an additional embodiment of the present invention. In one embodiment, the LSP illumination sub-system 102 is configured such that the pumping illumination 121 and the plasma-generated broadband radiation 133 occupy the same, or common, portions of NA space. In this regard, the pumping illumination 121 and the plasma-generated broadband radiation 133 may share the pupil of the LSP illumination sub-system 102.

In one embodiment, the LSP illumination sub-system 102 includes a cold mirror 603 having a reflective coating (not shown) that is reflective to the generated broadband radiation 133 (or a portion of the generated broadband radiation 133). Further, the cold mirror 603 is transparent to the pumping illumination 121. In one embodiment, the cold mirror 603 is positioned between a reflective surface of the collector 106 and the pump source 104. In another embodiment, the broadband radiation 133 and the pump illumination 121 are separated via the cold mirror 603. In this regard, the reflective coating of the cold mirror 603 may direct the reflected broadband radiation 304 (e.g., VUV light) to downstream optical elements. In another embodiment, the LSP illumination sub-system 102 includes a compensating optical element 602. It is noted herein that the cold mirror 603 may refract the pump illumination 121. The compensating element 602 may be inserted into the LSP illumination sub-system 102 in order to compensate for such refraction.

Figure 6B:
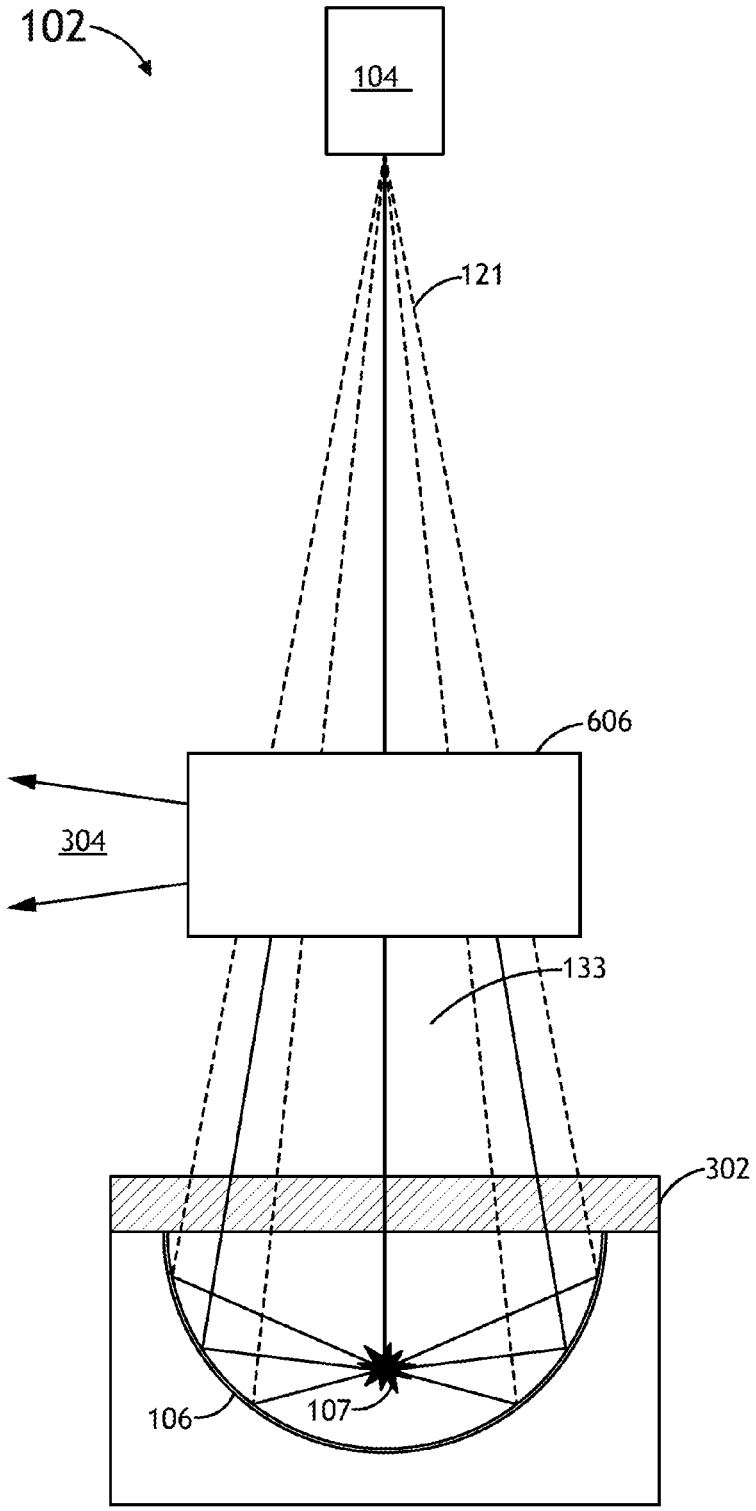
FIG. 6B is a schematic view of a laser sustained plasma sub-system including a total internal reflection (TIR) element, in accordance with one embodiment of the present invention.

In another embodiment, as shown in FIG. 6B, the LSP sub-system 102 may include a total internal reflection (TIR) optical element 606. In one embodiment, the broadband radiation 133 and the pump illumination 121 are separated via the TIR element 606. In one embodiment, the TIR element 606 is positioned between a reflective surface of the collector 106 and the pump source 104. In another embodiment, the TIR element 606 is arranged so as to spatially separate the pumping illumination 121 including the first wavelength and the emitted broadband radiation 133 including at least a second wavelength emitted from the plasma 107.

In one embodiment, the TIR element 606 is formed from a selected material (e.g., $CaF_2$, $MgF_2$ and the like) and arranged relative to the pump source 104 and the generated plasma 107 in order to establish total internal reflection of the plasma illumination 133 incident on the TIR element 606. Further, the TIR element 606 is formed from a material that is transparent to the pump illumination 121 from the pump source 104. For example, the material, position and orientation of the TIR element 606 may be selected such that the plasma illumination 133 undergoes total internal reflection at a first surface within the TIR element and exits the TIR element 606 at a second surface. The exiting plasma illumination 304 may then be directed to downstream optical elements, as described throughout the present disclosure. Further, the material, position and the orientation of the TIR element may be selected such that the pumping illumination 121 is refracted at the first surface and is transmitted through the TIR element. Then, the pumping illumination 121 exits the TIR element at a third surface toward the collector 106 for plasma generation. The use of a TIR element and other refractive-based optical elements suitable for separating pumping illumination, such as IR light, and plasma-generated broadband radiation, such as VUV light, is described in U.S. application Ser. No. 14/459,095, filed on Aug. 13, 2014, which is incorporated herein in the entirety.

Figure 7:
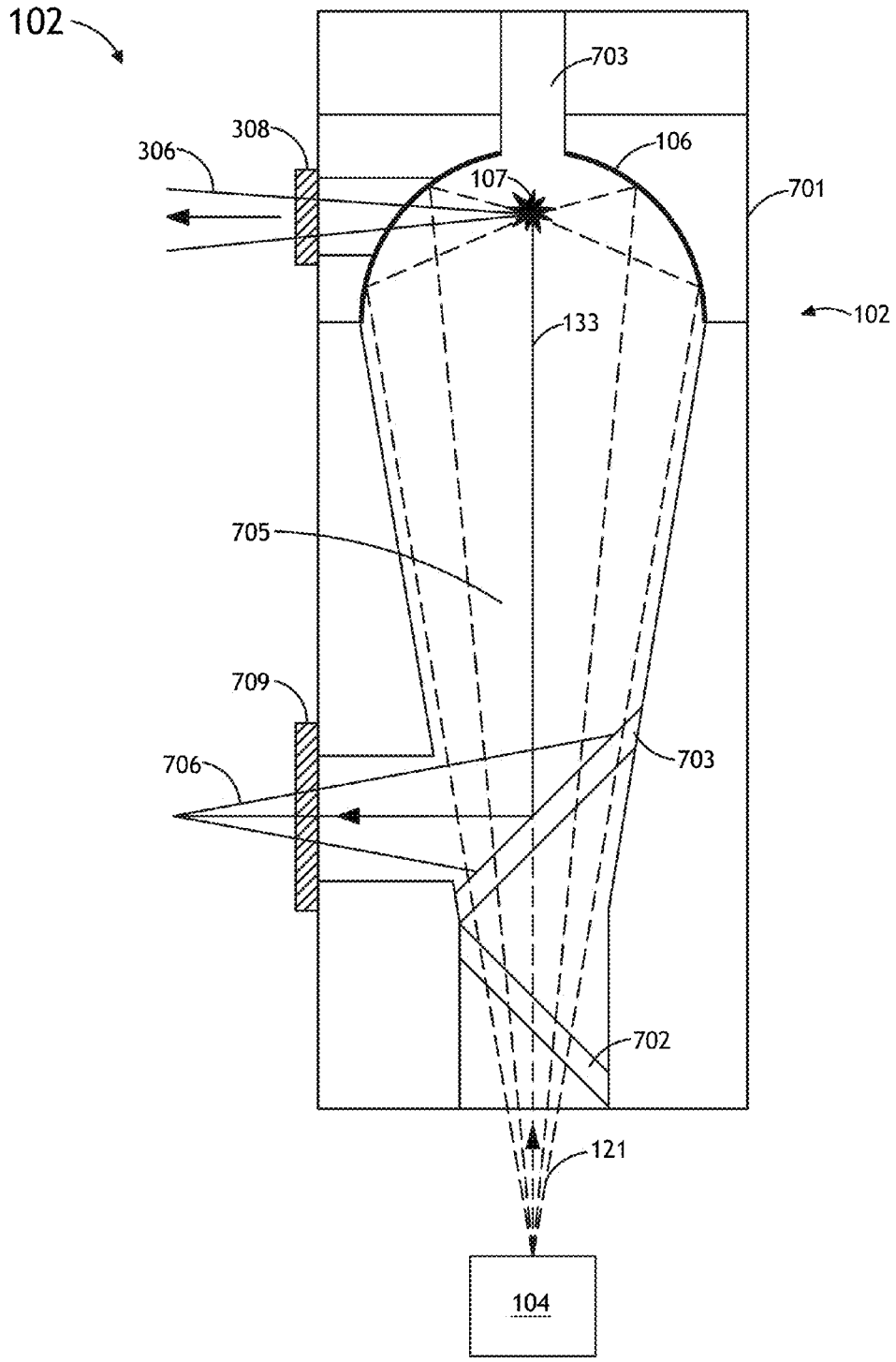
FIG. 7 is a schematic view of a laser sustained plasma sub-system, in accordance with one embodiment of the present invention.

FIG. 7 illustrates the LSP illumination sub-system 102 configured such that the pumping illumination 121 and the plasma-generated broadband radiation 133 occupy the same portion of NA space, in accordance with another embodiment of the present disclosure. As shown in FIG. 7, the incident pumping illumination is directed from beneath the collector 106 and passes through the cold mirror 703 and the corresponding compensating element 702. In another embodiment, the embodiment depicted in FIG. 7 does not require a chamber window, such as that depicted in FIG. 6. In one embodiment, the plasma gas is contained within chamber 701 and throughout the column 705 of the LSP illumination sub-system 102. In this regard, the collector 106, cold mirror 703 and window 709 form the cavity of chamber 701. In another embodiment, the column 705 maintains pressure due to the window 709, which is transparent to the broadband radiation 133 and allows a LSP output 706 to be transmitted to downstream optical elements. In another embodiment, channel 703 allows for control and cooling of the plasma 107 and the plasma plume.

It is noted herein that while the embodiments of the LSP illumination sub-system 102 have been described in the context of a plasma gas and the formation of the plasma within such gas occurring in a 'chamber,' this should not be interpreted as a limitation and is provided merely for illustrative purposes. It is contemplated herein that all of the LSP illumination sub-system embodiments described herein may be extended to architectures including plasma cells (e.g., see FIG. 2) and plasma bulbs for the purpose of generating broadband radiation 133.

It is noted herein that the power level of the broadband radiation emitted by the LSP illumination sub-system 102 is adjustable via the control of various parameters of the system 100. Further, it is recognized herein that through the adjustment of the power level of the emitted broadband radiation the imaging area on the sample 116 may be optimized or at least improved. In one embodiment, power level of the emitted broadband radiation may be adjusted by changing a shape of the generated plasma 107. For example, a power level of the pump source 104 may be adjusted in order to change a shape of the generated plasma 107 and, in turn, adjust the power output of the emitted broadband radiation 133. By way of another example, a wavelength of the pump source 104 may be adjusted in order to change a shape of the generated plasma 107 and, in turn, adjust the power output of the emitted broadband radiation 133. By way of another example, a gas pressure of the pumping gas within the laser sustained plasma sub-system 102 may be adjusted in order to change a shape of the generated plasma 107 and, in turn, adjust a power level of the emitted broadband radiation 133. By way of another example, a NA power distribution within the laser sustained plasma sub-system may be adjusted in order to change a shape of the generated plasma 107 and, in turn, adjust a power level of the emitted broadband radiation 133. It is noted herein that the above changes and adjustments may be carried out manually or automatically through a digital control system.

Figure 8:
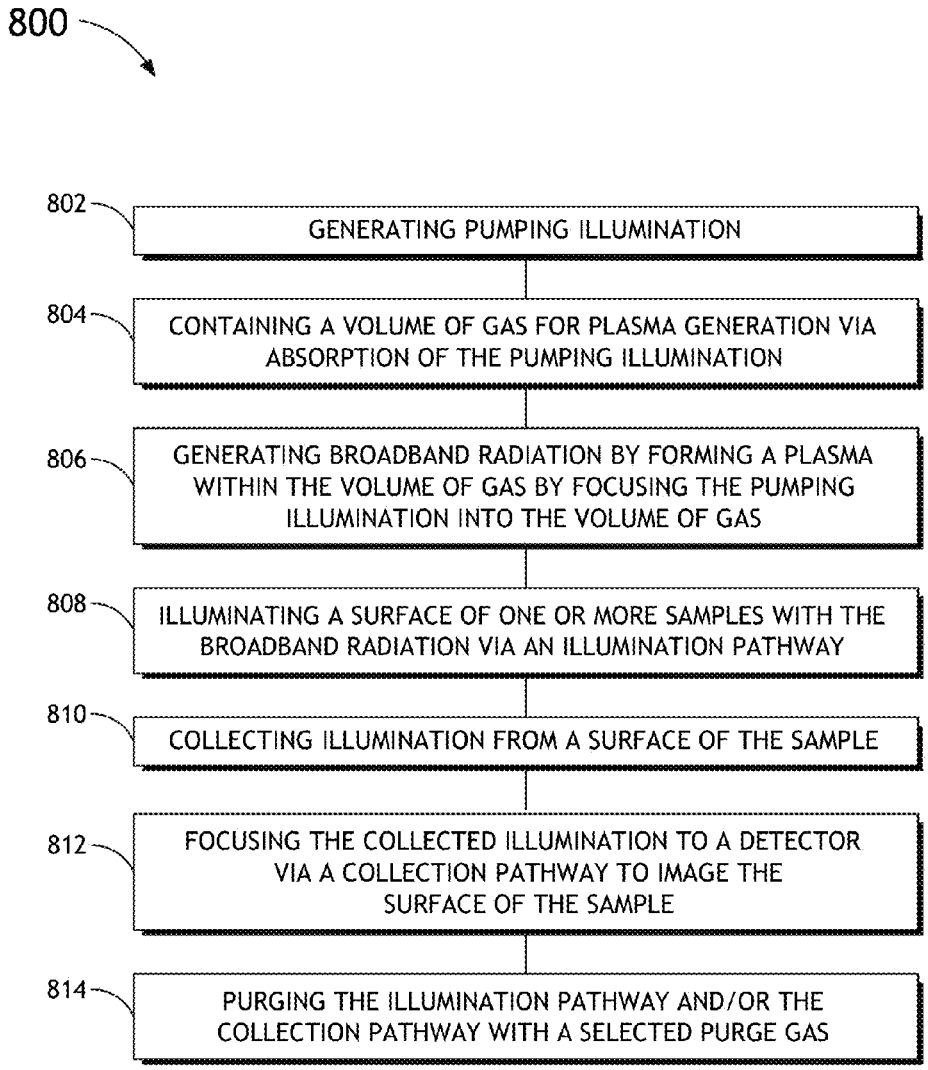
FIG. 8 is flow diagram depicting a method for imaging a sample with a laser sustained plasma illumination output, in accordance with one embodiment of the present invention.

FIG. 8 illustrates a flow diagram depicting a method 800 for imaging a sample with a laser sustained plasma illumination output, in accordance with one embodiment of the present disclosure. In step 802, pumping illumination 121 is generated that includes one or more first selected wavelengths, such as IR light. In step 804, a volume of gas suitable for plasma generation is contained. For example, a volume of plasma-generating gas may be contained within a plasma chamber, a plasma cell or a plasma bulb. In step 806, broadband radiation 133 including one or more second selected wavelengths (e.g., VUV light) is generated by forming a plasma within the volume of gas by focusing the pumping illumination 121 into the volume of gas. In step 808, a surface of one or more samples 116 is illuminated with at least a portion of the broadband radiation 133 emitted from the plasma 107 via an illumination pathway 113. In step 810, illumination 115 from a surface of the sample 116 is collected. For example, an objective 114 may collect illumination 115 scattered or reflected from the surface of the sample 116. In step 812, the collected illumination is focused onto a detector 118 via a collection pathway 117 to form an image of at least a portion of the surface of the sample 116. For example, the objective 114 (with or without additional optical elements) may focus the collected illumination onto the detector 118 to form an image of at least a portion of the surface of the sample 116. In step 814, the illumination pathway 113 and/or the collection pathway is purged with a selected purge gas (e.g., Ar).

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A system for imaging a sample with a laser sustained plasma illumination output comprising:

a laser sustained plasma illumination sub-system including:

a pump source configured to generate pumping illumination including one or more first selected wavelengths;

a gas containment element configured to contain a volume of gas;

a collector configured to focus the pumping illumination from the pumping source into the volume of gas contained within the gas containment element in order to generate a plasma within the volume of gas, wherein the plasma emits broadband radiation including one or more second selected wavelengths;

a sample stage for securing one or more samples;

an imaging sub-system including:

an illumination sub-system configured to illuminate a surface of the one or more samples with at least a portion of the broadband radiation emitted from the plasma of the laser sustained plasma illumination sub-system via an illumination pathway;

a detector;

an objective configured to collect illumination from a surface of the sample and focus the collected illumination via a collection pathway to a detector to form an image of at least a portion of the surface of the one or more samples; and a purged chamber containing a selected purge gas and configured to purge at least a portion of the illumination pathway and the collection pathway;

wherein the gas containment element includes a transmitting portion configured to optically couple an output of the laser sustained plasma illumination sub-system and the illumination sub-system, wherein the transmitting portion is configured to maintain separation between an atmosphere of the purge chamber and the volume of gas in the gas containment element of the laser sustained plasma illumination sub-system.

2. The system of claim 1, wherein the gas containment element comprises:

a chamber configured to contain a volume of gas.

3. The system of claim 1, wherein the gas containment element comprises:

a plasma cell configured to contain a volume of gas.

4. The system of claim 3, wherein the plasma cell comprises:

a transmission element; and one or more flanges disposed at one or more ends of the transmission element for containing the gas.

5. The system of claim 1, wherein the gas containment element comprises:

a plasma bulb configured to contain a volume of gas.

6. The system of claim 1, wherein the transmitting portion of the gas containment element is transparent to at least one of the pumping illumination and the emitted broadband radiation.

7. The system of claim 1, wherein the transmitting portion of the gas containment element is formed from at least one of CaF2, MgF2, crystalline quartz and sapphire.

8. The system of claim 1, wherein the gas containment element contains a gas including at least one an inert gas, a non-inert gas and a mixture of two or more gases.

9. The system of claim 1, wherein the gas containment element contains a gas including a mixture of a noble gas and one or more trace materials.

10. The system of claim 1, wherein the illumination source comprises:

one or more lasers.

11. The system of claim 10, wherein the one or more lasers comprise:

at least one of one or more infrared lasers, one or more visible lasers and one or more ultraviolet lasers.

12. The system of claim 10, wherein the one or more lasers comprise:

at least one of a diode laser, a continuous wave laser, or a broadband laser.

13. The system of claim 10, wherein the one or more lasers comprise:

a first laser emitting light of a first wavelength and at least a second laser emitting light of a second wavelength.

14. The system of claim 1 wherein the detector comprises:

at least one of CCD detector and a TDI detector.

15. The system of claim 1, wherein the purged chamber contains at least one of the illumination sub-system, the objective, and the detector of the imaging sub-system.

16. The system of claim 1, wherein the purging gas comprises:

at least one of a noble gas, an inert gas, a non-inert gas and a mixture of two or more gases.

17. The system of claim 1, wherein the pumping illumination and the broadband radiation occupy a common NA space at least within the laser sustained plasma illumination sub-system.

18. The system of claim 17, further comprising:

a cold mirror having a coating reflective to at least a portion of the broadband radiation, wherein the cold mirror is configured to separate the broadband radiation from the pumped illumination.

19. The system of claim 17, further comprising:

a total internal reflection (TIR) separation element, wherein the TIR separation element is configured to separate the broadband radiation from the pumped illumination.

20. The system of claim 1, wherein the pumping illumination and the broadband radiation occupy different portions of NA space.

21. The system of claim 20, further comprising:

one or more optical elements configured to divide a pupil of the laser sustained plasma sub-system laterally such that the pumping illumination and the broadband radiation occupy different portions of NA space.

22. The system of claim 20, further comprising:

one or more optical elements configured to divide a pupil of the laser sustained plasma sub-system such that the pumping illumination occupies a first portion of the pupil having a first NA range and the broadband radiation occupies a second portion of the pupil having a second NA range.

23. The system of claim 20, further comprising:

one or more optical elements configured to symmetrically divide a pupil of the laser sustained plasma sub-system such that the pumping illumination and the broadband radiation occupy different portions of NA space.

24. The system of claim 20, further comprising:

one or more optical elements configured to asymmetrically divide a pupil of the laser sustained plasma sub-system such that the pumping illumination and the broadband radiation occupy different portions of NA space.

25. The system of claim 1, wherein a power level of the emitted broadband radiation is adjustable.

26. The system of claim 25, wherein a power level of the emitted broadband radiation is adjustable by changing a shape of the generated plasma.

27. The system of claim 26, wherein the pump source is configured to change a power level of the pumping illumination in order to adjust a power level of the emitted broadband radiation by changing a shape of the generated plasma.

28. The system of claim 26, wherein the pump source is configured to change a wavelength of the pumping illumination in order to adjust a power level of the emitted broadband radiation by changing a shape of the generated plasma.

29. The system of claim 26, wherein the pump source is configured to change a gas pressure of the gas within the laser sustained plasma sub-system in order to adjust a power level of the emitted broadband radiation by changing a shape of the generated plasma.

30. The system of claim 26, wherein one or more optical elements are configured to change a NA power distribution with the laser sustained plasma sub-system in order to adjust a power level of the emitted broadband radiation by changing a shape of the generated plasma.

31. A method for imaging a sample with a laser sustained plasma illumination output comprising:

generating pumping illumination including one or more first selected wavelengths;

containing a volume of gas suitable for plasma generation;

generating broadband radiation including one or more second selected wavelengths by forming a plasma within the volume of gas by focusing the pumping illumination into the volume of gas;

illuminating a surface of one or more samples with at least a portion of the broadband radiation emitted from the plasma via an illumination pathway;

collecting illumination from a surface of the sample;

focusing the collected illumination onto a detector via a collection pathway to form an image of at least a portion of the surface of the sample; and purging at least a portion of the illumination pathway and the collection pathway with a selected purge gas; and maintaining separation between the selected purge gas and the volume of gas for plasma generation.

* * * * *